US009828572B2

(12) United States Patent
Kang et al.

(10) Patent No.: US 9,828,572 B2
(45) Date of Patent: Nov. 28, 2017

(54) METHOD FOR REMOVING ODOR OF ARTIFICIAL LEATHER AND ARTIFICIAL LEATHER MANUFACTURED USING THE SAME

(71) Applicants: Hyundai Motor Company, Seoul (KR); Kolonglotech. Inc., Gwacheon, Gyeonggi-Do (KR)

(72) Inventors: Gun Kang, Seoul (KR); Hyun Joo Seo, Seoul (KR); Mi Jung Yun, Gyeonggi-do (KR); Dae Seok Choi, Gyeongsangbuk-do (KR); Yong Tae Ha, Daegu (KR); Min Jeong Kim, Gyeongsangbuk-do (KR); Ju Ahn Kim, Daegu (KR); Ki Eop Kim, Daegu (KR); Yoon Jung Kwon, Gyeonggi-do (KR); Shin Hyouk Kang, Gyeongbuk-do (KR)

(73) Assignee: Hyundai Motor Company Kolonglotech, Inc., Seoul (KR)

( * ) Notice: Subject to any disclaimer, the term of this patent is extended or adjusted under 35 U.S.C. 154(b) by 583 days.

(21) Appl. No.: 14/475,977

(22) Filed: Sep. 3, 2014

(65) Prior Publication Data

US 2015/0140311 A1 May 21, 2015

(30) Foreign Application Priority Data

Nov. 21, 2013 (KR) ..... 10-2013-0141997

(51) Int. Cl.
*D06M 13/127* (2006.01)
*C11D 3/00* (2006.01)
(Continued)

(52) U.S. Cl.
CPC ..... *C11D 3/0068* (2013.01); *C11D 3/0031* (2013.01); *C11D 3/128* (2013.01);
(Continued)

(58) Field of Classification Search
CPC ..... C11D 3/0068; C11D 3/0031; C11D 3/128; C11D 7/02; C11D 11/0017; D06M 13/005; D06M 11/00; D06M 11/79
See application file for complete search history.

(56) References Cited

U.S. PATENT DOCUMENTS 5,338,579 A * 8/1994 Ogawa ..... B05D 1/185 427/387

FOREIGN PATENT DOCUMENTS

JP 06-327971 11/1994
JP 10-292057 11/1998
(Continued)

*Primary Examiner* — Eisa Elhilo
(74) *Attorney, Agent, or Firm* — Mintz Levin Cohn Ferris Glovsky and Popeo, P.C.; Peter F. Corless

(57) ABSTRACT

A method is provided for removing a volatile organic compound (VOC) contained in an artificial leather fabric and odor caused by the volatile organic compound by coating the artificial leather fabric with an adsorbent which reacts with a noxious substance containing the volatile organic compound (VOC); and immersing; washing; and drying the reacted artificial leather fabric. The method includes coating the adsorbent and immobilizing the volatile organic compound through a reaction, to prevent volatilization of the organic compound or reduce an amount thereof. Further, after the reaction between the artificial leather fabric and the adsorbent, the artificial leather fabric is washed, to remove the volatile organic compound immobilized on a surface of the fabric from the artificial leather.

17 Claims, 3 Drawing Sheets

(51) Int. Cl.

| | |
|---|---|
| ***C11D 11/00*** | (2006.01) |
| ***C11D 3/12*** | (2006.01) |
| ***C11D 7/02*** | (2006.01) |
| ***C11D 7/44*** | (2006.01) |
| ***D06M 11/00*** | (2006.01) |
| ***D06M 11/73*** | (2006.01) |
| ***D06M 11/79*** | (2006.01) |
| ***D06M 13/00*** | (2006.01) |

(52) U.S. Cl.

CPC ..... *C11D 7/02* (2013.01); *C11D 7/44* (2013.01); *C11D 11/0017* (2013.01); *D06M 11/00* (2013.01); *D06M 11/73* (2013.01); *D06M 11/79* (2013.01); *D06M 13/005* (2013.01); *Y10T 428/249921* (2015.04)

(56) References Cited

FOREIGN PATENT DOCUMENTS

| | | | |
|---|---|---|---|
| JP | 2003-093490 | A | 4/2003 |
| JP | 2006-239516 | A | 9/2006 |
| KR | 20-0279156 | A | 6/2002 |
| KR | 10-2002-0069308 | | 8/2002 |
| KR | 10-2007-0109278 | | 11/2007 |
| KR | 10-2009-0053336 | | 5/2009 |
| KR | 10-1099320 | B1 | 12/2011 |
| WO | 2010149521 | A1 | 12/2010 |

* cited by examiner

METHOD FOR REMOVING ODOR OF ARTIFICIAL LEATHER AND ARTIFICIAL LEATHER MANUFACTURED USING THE SAME

CROSS-REFERENCE TO RELATED APPLICATION

This application claims under 35 U.S.C. §119(a) the benefit of Korean Patent Application No. 10-2013-0141997 filed Nov. 21, 2013, the entire contents of which are incorporated herein by reference.

TECHNICAL FIELD

The present invention relates to a method for removing odor of an artificial leather and the artificial leather manufactured using the method. More particularly, the present invention relates to a method including: coating artificial leather fabric with an adsorbent to which reacts with a noxious substance containing a volatile organic compound (VOC); and immersing; washing; and drying the reacted artificial leather fabric, to thereby remove the volatile organic compound contained in artificial leather and the odor caused by the volatile organic compound, and the artificial leather manufactured using the method.

BACKGROUND

Artificial leather products used in a vehicle interior material, furniture for home and office, shoes, and the like have been manufactured while the finished products still contain a large amount of various volatile organic compounds (VOCs). In fact, an artificial leather fabric, for example, PVC (Polyvinyl chloride), Polyurethane (PU), and Thermo Polyurethane (TPU), is used as a base material for the artificial leather products and treated with various chemicals during the manufacturing process.

The organic compounds which are generated during the manufacturing process of the artificial leather are classified into a very-volatile organic compound (V-VOC), a volatile organic compound (VOC), and a semi-volatile organic compound (S-VOC) based on a boiling point thereof. The very-volatile organic compound (V-VOC) refers to a compound that has a low boiling point and naturally volatilizes and disappears and thus rarely has a bad influence on the human body. The semi-volatile organic compound (S-VOC) volatilizes at very high temperature of 240° C. or higher and thus rarely has a bad influence on the human body in daily life.

However, the volatile organic compound (VOC) has a bad influence on a user's body, for example, by causing various diseases and headache. In order to remove such a volatile organic compound (VOC), an adsorbent is sprayed and coated on the manufactured artificial leather fabrics and a reaction is performed for adsorption at a certain temperature range, thereby removing the volatile organic compound contained in the artificial leather and the odor caused by the volatile organic compound.

In one example of spraying, a method of manufacturing a chemically adsorbed film formed in a monomolecular film has been reported. The method includes: a process of spraying a solution containing a chlorosilane-based adsorbent having a molecule containing a straight carbon bond or a straight siloxane bond with a chlorosilyl group on its one end to react with a surface of a substrate; a washing process of removing the solution containing the chlorosilane-based adsorbent, which is not reacted with the substrate and remains on the substrate, by using a nonaqueous organic solvent; and a process of reacting the remaining chlorosilyl group with water.

In other example of coating, a method of manufacturing a chemical adsorption film has been reported. The method includes: reacting a chemical adsorbent with a surface of a base material containing an active hydrogen group; washing and removing a solution containing the unreacted adsorbent remaining on the base material by using an organic solvent; reacting the base material with water; and drying the resultant product to manufacture a chemical adsorbent film formed in a covalently bonded monomolecular film.

However, in such techniques described above, the volatile organic compound is immobilized or chemically bonded to the adsorbent. Indeed, the volatile organic compound cannot be actually removed, and does not volatile even under the conditions for volatilization.

Thus, in conventional methods, even if a volatile organic compound (VOC) is treated with an adsorbent or the like, the volatile organic compound is immobilized or chemically bonded to the adsorbent and remains on the surface of the artificial leather. Therefore, when the volatile organic compound is exposed under severe conditions, for example, high temperature in daily life, volatilization of the volatile organic compound may occur. As a result, the surrounding air may be contaminated and other damages may be caused by the volatile organic compounds.

In particular, if the volatile organic compound is used in a vehicle interior material, and since a vehicle is air-tightened and is frequently exposed to sunlight or a high-temperature weather condition, volatilization of the volatile organic compound occur. Therefore, the problem is more serious.

Accordingly, standards and regulations on odor and volatile organic compounds (VOCs) have been strengthened. However, the conventional method of adsorbing a volatile organic compound (VOC) including spraying and reacting an adsorbent hardly satisfies the required standards. Therefore, the vehicle users have complained about serious problems after use for a considerable time. In general, even after a certain period of use, the users have not yet satisfied because of odor.

Therefore, a method for removing a noxious odor substance containing a volatile organic compound (VOC) from the artificial leather has been urgently needed.

The above information disclosed in this Background section is only for enhancement of understanding of the background of the invention and therefore it may contain information that does not form the prior art that is already known in this country to a person of ordinary skill in the art.

SUMMARY

The present invention provides technical solutions to the above-described problems associated with related arts.

The present invention provides a method comprising: coating an artificial leather fabric with an adsorbent which reacts with a noxious substance containing a volatile organic compound (VOC); immersing; washing; and drying the reacted artificial leather fabric to remove the volatile organic compound contained in the artificial leather and odor caused by the volatile organic compound.

Further, the present invention provides an artificial leather fabric which is manufactured using the above-described method and contains toluene of about 300 $\mu g/m^3$ or less and from which the odor is removed, and an artificial leather product manufactured using the same artificial leather fabric.

In one aspect, the present invention provides a method for removing odor of an artificial leather and the method may include adsorbing a volatile organic compound (VOC) in the artificial leather fabric with an adsorbent and removing the volatile organic compound (VOC) reacted with and bonded to the adsorbent through a washing process.

In another aspect, the present invention provides an artificial leather fabric which is manufactured by using the above-described method and from which the odor is removed, and an artificial leather product manufactured using the artificial leather fabric.

According to one exemplary embodiment of the present invention, a method for removing odor of an artificial leather includes coating of an adsorbent and immobilizing a volatile organic compound through a reaction between the adsorbent and the VOC, to thereby prevent volatilization or reduce an amount of the volatile organic compound.

Further, after coating the artificial leather fabric with the adsorbent, the artificial leather fabric is washed, to thereby actually remove the volatile organic compound immobilized on the surface of the fabric from the artificial leather. Therefore, the amount of the volatile organic compound contained in the finished product may be reduced remarkably.

Furthermore, the artificial leather manufactured according to another exemplary embodiments of the present invention may prevent a user from physical irritation, for example, new car syndrome which is directly caused by the volatile organic compound, and further may also improve the quality of consumer's life by preventing cancer, suppressing atopic diseases, reducing stress, and maintaining pleasant air condition inside a vehicle.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
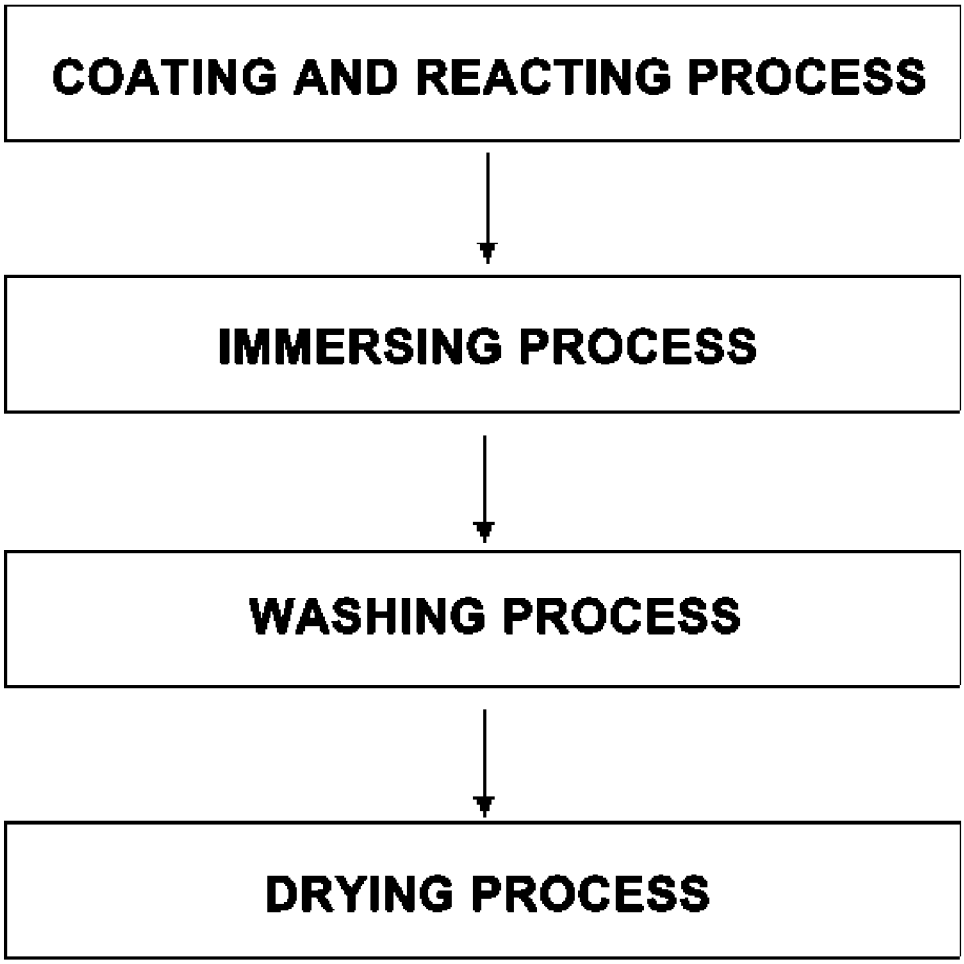
FIG. 1 illustrates an exemplary process diagram of a manufacturing method according to an exemplary embodiment of the present invention.

Reference numbers set forth in the Drawings includes reference to the following elements as further discussed below:

100: Washing apparatus
110: Artificial leather fabric
120: Guide rollers
130: Washing tank
140: Vibrating washer
141: First roller
142: Second roller
143: Rotation axis
144: Holes penetrating the inside and the outside
145: Rotation direction
150: Water
151: In-out
152: Out-in It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, the present invention will be explained in more detail with reference to an exemplary embodiment.

In one exemplary embodiment of the present invention, a method for removing odor of an artificial leather may include adsorbing a volatile organic compound (VOC) in the artificial leather fabric with an adsorbent and removing the volatile organic compound (VOC) bonded to the adsorbent through a washing process. In particular, the method for removing the odor of the artificial leather may include: (a) an adsorbing process of coating the artificial leather fabric with the adsorbent and reacting the adsorbent with the volatile organic compound (VOC) in the artificial leather fabric; (b) an immersing process of immersing the artificial leather fabric coated with the adsorbent in an immersion tank; (c) a washing process of washing the immersed artificial leather fabric; and (d) a drying process of drying the washed artificial leather fabric.

Hereinafter, each process of the method for removing the odor of the artificial leather according to the present invention will be explained in detail.

Process (a): An Adsorbing Process of Coating the Artificial Leather Fabric With the Adsorbent and Reacting the Adsorbent with the Volatile Organic Compound (VOC) in the Artificial Leather Fabric:

The artificial leather, unlike a natural leather, may include synthetic materials and is used as an alternative to various types of natural leather. In one exemplary embodiment of the present invention, the artificial leather fabric may be coated with the adsorbent to adsorb and remove various volatile organic compounds (VOCs) present in the artificial leather fabric. Herein, the adsorbent may include a physical adsorbent and a chemical adsorbent, or a combination thereof.

In exemplary embodiments, the physical adsorbent may include, without limitation, one or more selected from the group consisting of porous zeolite, perlite, celite, illite, loess, hardwood charcoal, carbon powder, white carbon, active carbon, and a mixture thereof. In another exemplary embodiments, the chemical adsorbent containing a functional group, such as an amine group-containing adsorbent or a carboxylic group-containing adsorbent, which chemically reacts with formaldehyde and the volatile organic compound in the artificial leather fabric, may be used.

The physical adsorbent is not limited to the above-described adsorbents and may include a mixture of one or more adsorbents. In particular, zeolite is versatile to adsorb a volatile organic compound, release anions helpful to the human body, intercept electromagnetic waves, prevent oxidation or facilitate reduction, and improve a hygroscopic property. Therefore, in certain exemplary embodiments, zeolite may be used.

The chemical adsorbent may include, without limitation, a polymer-containing emulsion compound, such as Grafton (Osteotech, US), and may be obtained by irradiating a mixture of water, acrylic acid, ethyl alcohol, glucose, and urea or glycolic acid as main components, and an inorganic deodorant, such as KESMON (Toagosei, JP), which is an aldehyde deodorant. The chemical adsorbents have an amine group and a carboxyl group at their ends, so that the chemical reaction with formaldehyde easily occurs. Therefore, a barely reactive amine compound and an ammonium salt are produced and further release of the volatile organic compound may be prevented. The chemical adsorbents may also be used alone or in a mixture thereof.

In other exemplary embodiments, when using a mixture of the chemical adsorbents, the Grafton and the inorganic deodorant which have an amine group at one end and a carboxyl group at the other end may be mixed at a weight ratio of about 1:1 to 3:1, or at 1:1. When the Grafton and the inorganic deodorant are mixed at a weight ratio of less than 1:1, an effect of adsorbing and removing the VOC may not be significant; and when mixed at a weight ratio greater than 3:1, cost-efficiency may decrease. In particular, formaldehyde may be well adsorbed by a chemical adsorbent, and toluene may be well adsorbed by a physical adsorbent such as zeolite. Therefore, in another exemplary embodiment, a mixture of a physical adsorbent and a chemical adsorbent may be used.

In other exemplary embodiments, the artificial leather fabric may be coated with the adsorbent by a method, which may include: preparing a coating solution obtained by dispersing or dissolving the adsorbent in a solvent; performing a coating process; an immersing process, or a spraying process. Herein, the solvent may include, without limitation, water, alcohol, acetone, or the like.

In exemplary embodiments, in process (a), the reaction after coating may be performed at about 50 to 130° C. for about 3 to 10 minutes, and in such condition, the immobilization reaction between the adsorbent and the volatile organic compound may occur. In addition, the reaction may be performed at about 80 to 100° C. for about 3 to 10 minutes. When the reaction is performed below 50° C., the immobilization reaction between the adsorbent and the volatile organic compound may not readily occur; and when the reaction is performed at a temperature greater than 130° C., the surface of artificial leather has luster and may be deformed.

Process (b): An Immersing Process of Immersing the Artificial Leather Fabric Coated with the Adsorbent in an Immersion Tank:

In one exemplary embodiment, during the immersing process, the adsorbent and the volatile organic compound contained in the artificial leather fabric may be dissolved and then loosely immobilized or bonded to the artificial leather fabric. Thus, the adsorbent and the volatile organic compound may be more easily removed. In particular, the immersing process may be performed at about 20 to 60° C. for about 1 to 5 minutes in the immersion solution which contain an alkaline compound, such as sodium hydroxide, and a surfactant. When the immersing temperature is below a predetermined temperature or the immersing time is below a predetermined time range, the volatile organic compound reacted with the adsorbent may not be eliminated; and when the immersing temperature is greater than a predetermined temperature or the immersing time is greater than a predetermined time range, deterioration in quality may occur on the surface of the artificial leather fabric.

In another exemplary embodiment, the surfactant may include, without limitation, one or more selected from the group consisting of an anionic surfactant, a non-ionic surfactant, and an amphoteric surfactant. The anionic surfactant may include, without limitation, one or more selected from the group consisting of sulfuric ester of higher alcohol, alkylbenzene sulfonic acid salt, aliphatic sulfonic acid salt, and sulfuric ester of polyethylene glycol alkyl ether. Further, the non-ionic surfactant may include, without limitation, one or more selected from the group consisting of an alkyl ester type, an alkyl ether type, and an alkyl phenyl ether type of polyethylene glycol. Furthermore, the amphoteric surfactant may include, without limitation, one or more selected from the group consisting of lauryl betaine, stearine betaine, lauryl-β-alanine, stearine-β-alanine, lauryl-D-(aminoether) glycine, and octyl-D-(aminoether)glycine.

Process (c): A Washing Process of Washing the Immersed Artificial Leather Fabric:

In one exemplary embodiment, by washing the immersed artificial leather fabric, most of volatile organic compounds may be washed and removed. The washing process may be performed by using a washing method and washing apparatuses which are typically used for manufacturing fiber. In another exemplary embodiment, a washing apparatus may include a vibrating washer as illustrated in FIGS. 2 and 3.

When the vibrating washer is used, the volatile organic compound may be removed more easily while the highest quality of artificial leather may be maintained.

Figure 2:
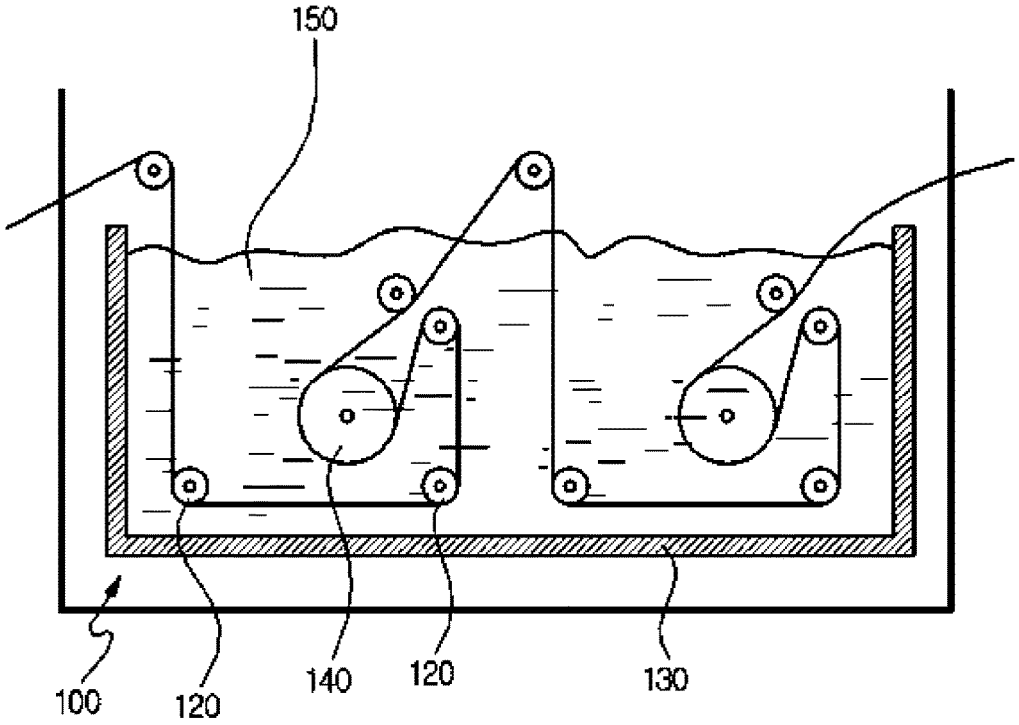
FIG. 2 illustrates an exemplary washing apparatus including a vibrating washer according to an exemplary embodiment of the present invention.

In particular, FIG. 2 is an exemplary schematic diagram of a washing apparatus 100 that includes a vibrating washer 140. The washing apparatus 100 may include multiple guide rollers 120 configured to smoothly supply artificial leather fabric 110, a washing tank 130 to be filled with water 150, and the vibrating washer 140 disposed within the washing tank 130. One or more vibrating washers 140 may be provided and used.

Figure 3:
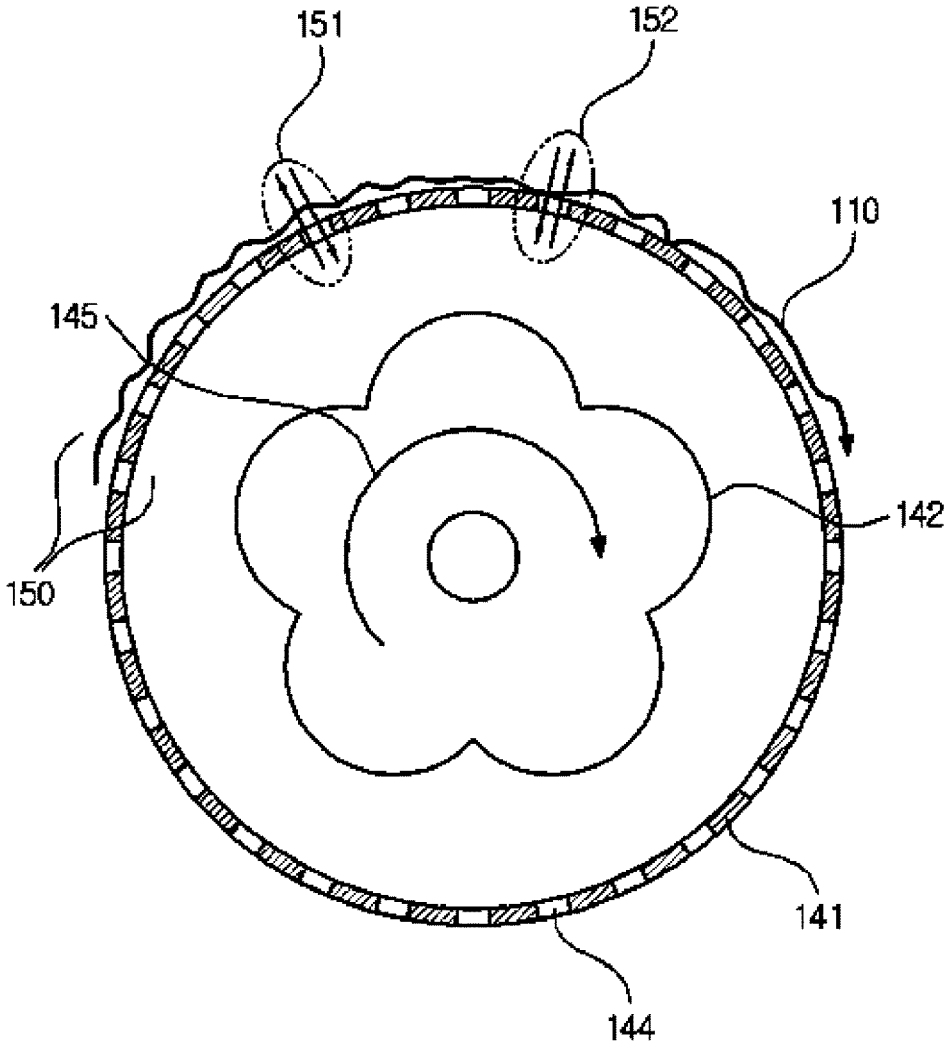
FIG. 3 illustrates an exemplary structure of the vibrating washer and a rotation direction of the vibrating washer according to an exemplary embodiment of the present invention.

FIG. 3 illustrates an exemplary vibrating washer 140 including a first roller 141 and a second roller 142. The inside of the first roller 141 may be empty, and a surface of the first roller 141 may include a plurality of apertures 144 that penetrate the interior and the exterior. The second roller 142 may be disposed within the first roller 141 and may have the same rotation axis 143 as the first roller 141, and a surface of the second roller 142 may include a curved uneven portion. In the vibrating washer 140, the second roller 142 including the curved uneven portion at its surface may be rotated in the same rotation direction 145 at a greater speed than the first roller 141, and water waves may be generated by the rotation, and the generated water waves may form a flow of in-out 151 and a flow of out-in 152 of the water 150 through multiple apertures penetrating the interior and the exterior of a surface of the first roller 141. When these flows of the water are continuously formed, vibrations may be generated at the artificial leather fabric 110, and thus, reaction products contained in the fabric 110 including the volatile organic compounds immobilized to the adsorbent and other odor causing substances are washed and removed.

Conditions of the washing process may be adjusted while characteristics of the fabric may be maintained. In exemplary embodiments, the washing process may be performed at about 40 to 80° C. for about 3 to 20 minutes. In another exemplary embodiment, the washing process may be performed at about 50 to 70° C. for about 5 to 15 minutes. Thus, most of the volatile organic compounds (VOCs) remaining in the artificial leather fabric may be washed and removed. In other exemplary embodiments, the washing process may be performed for about 1 to 3 times according to the balance between the objectives of maintaining a quality of the artificial leather fabric and reducing an amount of the volatile organic compound.

Process (d): A Drying Process of Drying the Washed Artificial Leather Fabric:

In one exemplary embodiment, through the process (d), the volatile organic compound remaining in the artificial leather fabric may be further volatilized and removed, and the quality of the artificial leather fabric may be improved. The drying process may be performed at about 80 to 130° C., or at about 90 to 120° C. to maintain characteristics of the fabric and maximize an odor removal rate. In another exemplary embodiment, the drying process may be performed for about 2 to 5 minutes.

By the method for removing odor of artificial leather including the processes (a) to (d), the present invention provides the artificial leather fabric from which the volatile organic compound and odor caused by the volatile organic compound are remarkably removed. Further, artificial leather fabric manufactured according to the present invention may be used for interior material of a vehicle, furniture for home and office use, shoes, and the like.

EXAMPLES

The following examples illustrate the invention and are not intended to limit the same.

Hereinafter, the present invention will be explained in more detail with reference to examples. However, the following examples are provided for illustration only and are not intended to limit the scope of the present invention.

Example 1

Polyvinyl chloride (PVC) artificial leather fabric was coated with an adsorbent including zeolite, and then placed for reaction at 90° C. for 5 minutes. Thereafter, the artificial leather fabric was immersed in an immersion solution containing 2 g/L of sodium hydroxide and 804 g/L of Tween 100 at 40° C. for 3 minutes.

The immersed artificial leather fabric was placed in a washing apparatus for a washing process. The washing process was carried out at 60° C. for 3 minutes. Then, the artificial leather fabric was placed in a drying room at 110° C. for 3 minutes. As a result, the artificial leather fabric according to one exemplary embodiment of the present invention was obtained.

Example 2

An artificial leather fabric was obtained in the same manner as Example 1, but a vibrating washing apparatus including a vibrating washer illustrated in FIGS. 2 and 3 was used during a washing process.

Comparative Example 1

An artificial leather fabric was coated with the same adsorbent as used in Example 1, and then placed for reaction at 90° C. for 10 minutes. As a result, the artificial leather fabric for Comparative Example 1 was obtained.

Comparative Example 2

An artificial leather fabric was obtained in the same manner as Example 1 except the adsorbent.

Comparative Example 3

An artificial leather fabric was obtained in the same manner as Example 1, but the adsorbent as used in Example 1 was reacted at 40° C.

Comparative Example 4

An unprocessed PVC (Polyvinyl chloride) artificial leather fabric was prepared for Comparative Example 4.

Table 1 lists process conditions for Examples 1 and 2, and Comparative Examples 1 to 4.

TABLE 1

| Experimental condition | Example 1 | Example 2 | Comparative Example 1 | Comparative Example 2 | Comparative Example 3 | Comparative Example 4 |
|---|---|---|---|---|---|---|
| Treated with adsorbent (zeolite) | Treated | Treated | Treated | Not treated | Treated | — |

TABLE 1-continued

| Experimental condition | Example 1 | Example 2 | Comparative Example 1 | Comparative Example 2 | Comparative Example 3 | Comparative Example 4 |
|---|---|---|---|---|---|---|
| Reaction temperature (° C.) | 90 | 90 | 90 | 90 | 40 | — |
| Reaction time (min) | 10 min | 10 min | 10 min | 10 min | 10 min | — |
| Immersion temperature (° C.) | 40 | 40 | — | 40 | 40 | — |
| Immersion time (min) | 3 min | 3 min | — | 3 min | 3 min | — |
| Washing temperature (° C.) | 60 | 60 | — | 60 | 60 | — |
| Washing time (min) | 10 min | 10 min | — | 10 min | 10 min | — |
| Drying temperature (° C.) | 110 | 110 | — | 110 | 110 | — |
| Drying time (min) | 3 min | 3 min | — | 3 min | 3 min | — |

Evaluations

The amounts of volatile organic compounds, such as toluene, formaldehyde, and benzene, remaining in the artificial leather fabrics are listed in Table 1. The odor measurements were performed according to a MS 300-55 standard test method of volatile organic compound for vehicle interior material.

TABLE 2

| Compound (Requirement) | Example 1 | Example 2 | Comparative Example 1 | Comparative Example 2 | Comparative Example 3 | Comparative Example 4 |
|---|---|---|---|---|---|---|
| Benzene (30 or less) | ND | ND | ND | ND | ND | 15 |
| Toluene (100 or less) | 266 | 184 | 2598 | 2378 | 3745 | 5329 |
| Ethyl benzene (1600 or less) | 24 | 12 | 109 | 98 | 157 | 235 |
| Xylene (870 or less) | 19 | 7 | 115 | 146 | 177 | 215 |
| Styrene (300 or less) | ND | ND | ND | ND | 10 | 17 |
| Formaldehyde (250 or less) | ND | ND | ND | ND | 54 | 67 |

* ND: Not Detected

According to Table 2, the amounts of volatile organic compounds contained in the artificial leather fabric of Examples 1 and 2 according to one exemplary embodiment of the present invention are remarkably reduced compared to Comparative Example 4 of non-treated PVC (polyvinyl chloride) artificial leather fabric without odor removing process. Further, for Examples 1 and 2 which were treated with the adsorbent and underwent a washing process, the amounts of volatile organic compounds contained in the artificial leather fabric are remarkably reduced compared to Comparative Example 1, which was only treated with the adsorbent.

Meanwhile, for Comparative Example 2 which underwent a washing process without treatment with the adsorbent, the artificial leather fabric thereof still contains large amounts of volatile organic compounds compared to Examples 1 and 2. However, the artificial leather fabric contains less amounts of volatile organic compounds than Comparative Example 1 which is treated only with the adsorbent. Therefore, a washing process may be a more effective process for removing volatile organic compounds contained in artificial leather fabric.

Further, Comparative Example 3 in which the reaction temperature does not correspond to the condition of the present invention indicates that although the other conditions, particularly, of the washing process are satisfied, the artificial leather fabric still contains a considerable amount of volatile organic compounds. Therefore, the reaction temperature of the adsorbent is important for removing the volatile organic compounds. Additionally, as shown in Table 2, the method for removing the odor of the artificial leather according to the present invention including the treatment with the adsorbent and the washing process is very effective in removing the volatile organic compounds, particularly, toluene.

Moreover, among other volatile organic compounds (VOCs), toluene is typically contained the most in artificial leather fabrics. Toluene is a noxious compound that causes general fatigue, dizziness, lethargy, and more severely, dyspnea. Moreover, repeated exposure to toluene may cause headache, ennui, powerlessness, nausea, memory problem, anorexia, and the like. Typically, toluene contained in finished artificial leather fabric products is detected in an amount of about 5000 $\mu g/m^3$ or more by a volatile organic compound (VOC) precision method. To the contrary, toluene is detected in an amount of 300 μg/m$^3$ or less from the artificial leather fabric prepared by the method of the present invention. Thus, the amount of toluene remaining may be reduced by about 90% or more.

The amounts of the other substances are less than the amount of toluene, but the other substances may be removed more effectively by the method of the present invention. Therefore, odor caused by the other compounds may be significantly removed. In other words, the method for removing odor of the artificial leather according to the present invention may be more effective in reducing an amount of volatile organic compounds (VOCs), and particularly, in reducing an amount of toluene, to thereby prevent a user from physical irritation caused by the volatile organic compounds and improve the quality of consumer's life using such artificial leather.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents. Artificial leather manufactured according to the present method may be widely used in vehicle interior material, furniture for home and office use, shoes, and the like.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A method for removing odor of an artificial leather, comprising:

an adsorbing process of coating an artificial leather fabric with an adsorbent and reacting the adsorbent with a volatile organic compound (VOC) in the artificial leather fabric;

an immersing process of immersing the artificial leather fabric coated with the adsorbent in an immersion tank;

a washing process of washing the immersed artificial leather fabric; and a drying process of drying the washed artificial leather fabric.

2. The method for removing odor of the artificial leather of claim 1, wherein the adsorbent includes a physical adsorbent, a chemical adsorbent, or a combination thereof.

3. The method for removing odor of the artificial leather of claim 2, wherein the physical adsorbent includes one or more selected from the group consisting of: zeolite, perlite, celite, illite, loess, hardwood charcoal, carbon powder, white carbon, active carbon, and a mixture thereof.

4. The method for removing odor of the artificial leather of claim 2, wherein the chemical adsorbent comprises i) a polymer-containing emulsion compound obtained by irradiating a mixture comprising water, acrylic acid, ethyl alcohol, glucose and urea and ii) an inorganic deodorant, wherein the chemical adsorbent comprises the polymer-containing emulsion compound and the inorganic deodorant at a weight ratio between about 1:1 to about 3:1.

5. The method for removing odor of the artificial leather of claim 1, wherein the coating of the adsorbing process is performed by a spray coating process, or an immersing coating process.

6. The method for removing odor of the artificial leather of claim 1, wherein the reaction between the adsorbent and the volatile organic compound (VOC) of the absorbing process is carried out at about 50 to 130° C. for about 3 to 10 minutes.

7. The method for removing odor of the artificial leather of claim 1, wherein the immersing process of the immersing process is performed at about 20 to 60° C. for about 1 to 5 minutes in an immersion solution containing an alkaline compound and a surfactant.

8. The method for removing odor of the artificial leather of claim 7, wherein the surfactant is an anionic surfactant, a non-ionic surfactant, and an amphoteric surfactant, or a mixture thereof.

9. The method for removing odor of the artificial leather of claim 8, wherein the anionic surfactant includes one or more selected from the group consisting of: sulfuric ester of greater alcohol, alkylbenzene sulfonic acid salt, aliphatic sulfonic acid salt, and sulfuric ester of polyethylene glycol alkyl ether.

10. The method for removing odor of the artificial leather of claim 8, wherein the non-ionic surfactant includes one or more selected from the group consisting of: an alkyl ester type, an alkyl ether type, and an alkyl phenyl ether type of polyethylene glycol.

11. The method for removing odor of the artificial leather of claim 8, wherein the amphoteric surfactant includes one or more selected from the group consisting of: lauryl betaine, stearine betaine, lauryl-β-alanine, stearine-β-alanine, lauryl-D-(aminoether)glycine, and octyl-D-(aminoether)glycine.

12. The method for removing odor of the artificial leather of claim 1, wherein the washing process of the washing process is performed at about 40 to 80° C. for about 3 to 20 minutes, 1 to 3 times.

13. The method for removing odor of the artificial leather of claim 1, wherein the drying process of the drying process is performed for about 2 to 5 minutes.

14. An artificial leather fabric manufactured using the method of claim 1, and from which odor is removed.

15. The artificial leather fabric of claim 14, wherein the artificial leather fabric contains toluene in an amount of about 300 μg/m$^3$ or less.

16. A leather product manufactured from the artificial leather fabric of claim 15.

17. The method for removing odor of the artificial leather of claim 4, wherein the mixture for obtaining the polymer-containing emulsion compound further comprises glycolic acid.

* * * * *